US008732989B1

(12) United States Patent
Turnbull

(10) Patent No.: US 8,732,989 B1
(45) **Date of Patent: *May 27, 2014**

(54) SNOWPLOW WHEEL KIT

(76) Inventor: Ron Turnbull, Montrose, CO (US)

( * ) Notice: Subject to any disclaimer, the term of this patent is extended or adjusted under 35 U.S.C. 154(b) by 289 days.

This patent is subject to a terminal disclaimer.

(21) Appl. No.: 13/270,453

(22) Filed: Oct. 11, 2011

Related U.S. Application Data

(63) Continuation-in-part of application No. 12/611,092, filed on Nov. 2, 2009, now Pat. No. 8,033,036.

(60) Provisional application No. 61/110,085, filed on Oct. 31, 2008.

(51) Int. Cl.
*E01H 5/06* (2006.01)

(52) U.S. Cl.
USPC ..... 37/270

(58) Field of Classification Search
USPC ..... 37/231–233, 263, 266, 271, 270; 172/811–817
See application file for complete search history.

(56) References Cited

U.S. PATENT DOCUMENTS 1,536,172 A * 5/1925 Webb ..... 37/281
2,061,585 A * 11/1936 Meyer ..... 37/233
2,094,515 A * 9/1937 Abbe ..... 37/232
2,513,231 A * 6/1950 Bourne ..... 37/271
3,270,367 A * 9/1966 Loos ..... 16/19
3,466,766 A * 9/1969 Kahlbacher ..... 37/233
4,259,794 A * 4/1981 Rath ..... 37/233
4,905,387 A 3/1990 Street
5,485,690 A * 1/1996 MacQueen ..... 37/271
6,050,008 A 4/2000 Doornek et al.
6,094,846 A 8/2000 Feller

FOREIGN PATENT DOCUMENTS

CA 2436616 A1 2/2005

* cited by examiner

*Primary Examiner* — Robert Pezzuto

(57) ABSTRACT

The present snowplow wheel kit converts a standard snowplow for use on unimproved surfaces. The snowplow wheel kit is designed to support the weight of the snowplow blade on swiveling wheel assemblies which are mounted to the rear of the snowplow blade and have the ability to turn in all directions. The tires ride on top of the unimproved surface, allowing the edge of the snowplow blade to travel just above the ground surface, thus removing the snow without the blade coming in direct contact with the soft underlying surface. The swivel feature of the wheel assemblies allows the blade to travel over the surface smoothly while maintaining the desired height of the blade edge from the surface. In addition, this feature allows for the plow blade to be fully functional when back-plowing, using the rear of the plow blade to drag snow while the vehicle is moving rearward.

8 Claims, 5 Drawing Sheets

SNOWPLOW WHEEL KIT

I claim benefit of my previously filed U.S. Provisional Utility Application No. 61/110,085 filed Oct. 31, 2008 and U.S. Utility patent application Ser. No. 12/611,092 filed Nov. 2, 2009.

BACKGROUND OF THE INVENTION

The present snowplow wheel kit converts a standard snowplow for use on unimproved surfaces. The conventional contractor-grade snowplow, being approximately 10 feet wide and weighing in the area of 1,000 pounds, is designed to scrape snow from a hard-finish surface by using the weight of the blade assembly to apply direct pressure to the hard surface. This process allows the blade edge to move across the hard surface, removing the snow from that surface. Adjustment of blade height above the hard surface is achieved on conventional snowplow blades by the use of metal shoes or skid plates attached to the rear of the blade assembly, supporting the weight of the snowplow blade and holding the blade edge above the surface being plowed.

When removing snow from unimproved surfaces such as dirt or gravel, the snowplow blade tends to dig into the soft surface and pushes the surface material along with the snow. This method does not allow for the removal of snow without also removing the surface material beneath the snow. The use of adjustable shoes or skid plates mounted on the rear of the snowplow blade only digs further into the unimproved surface or soft material to remove more of the base along with the snow.

The present Snowplow Wheel Kit is designed to address the foregoing problems by providing multi-directional swiveling wheel assemblies mounted to a snowplow blade rear end thereby allowing the blade to travel over unimproved surfaces smoothly while maintaining the desired height of blade edge from the surface and further allowing back-plowing.

SUMMARY OF THE INVENTION

The present snowplow wheel kit converts a standard snowplow for use on unimproved surfaces. The snowplow wheel kit is designed to support the weight of the snowplow blade on swiveling wheel assemblies which are mounted to the rear of the snowplow blade and have the ability to turn in all directions. The tires ride on top of the unimproved surface, allowing the edge of the snowplow blade to travel just above the ground surface, thus removing the snow without the blade coming in direct contact with the soft underlying surface. The swivel feature of the wheel assemblies allows the blade to travel over the surface smoothly while maintaining the desired height of the blade edge from the surface. In addition, this feature allows for the plow blade to be fully functional when "back-plowing", using the rear of the plow blade to drag snow while the vehicle is moving rearward.

The height of the snowplow wheel kit is adjustable to provide for any underlying surface conditions. This concept also allows for the plow to be used on improved surfaces by simply adjusting the wheel height to allow the snowplow's blade edge to come into contact with the hard surface.

The present snowplow wheel kit offers an economical and efficient conversion for the standard contractor-style snowplow blade used for commercial and residential snow removal where dirt, gravel and unimproved surfaces exist.

In this respect, before explaining the current embodiments of the improved snowplow wheel kit in detail, it is to be understood that the snowplow wheel kit is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved snowplow wheel kit. It is therefore important that the claims be regarded as including such equivalent constructions insofar as they do not depart from the spirit and scope of the snowplow wheel kit. It is also to be understood that the phraseology and terminology employed herein are for purposes of description and should not be regarded as limiting.

BRIEF DESCRIPTION OF THE DRAWINGS

Figures

DETAILED DESCRIPTION OF THE PREFERRED EMBODIMENT

Figure 1:
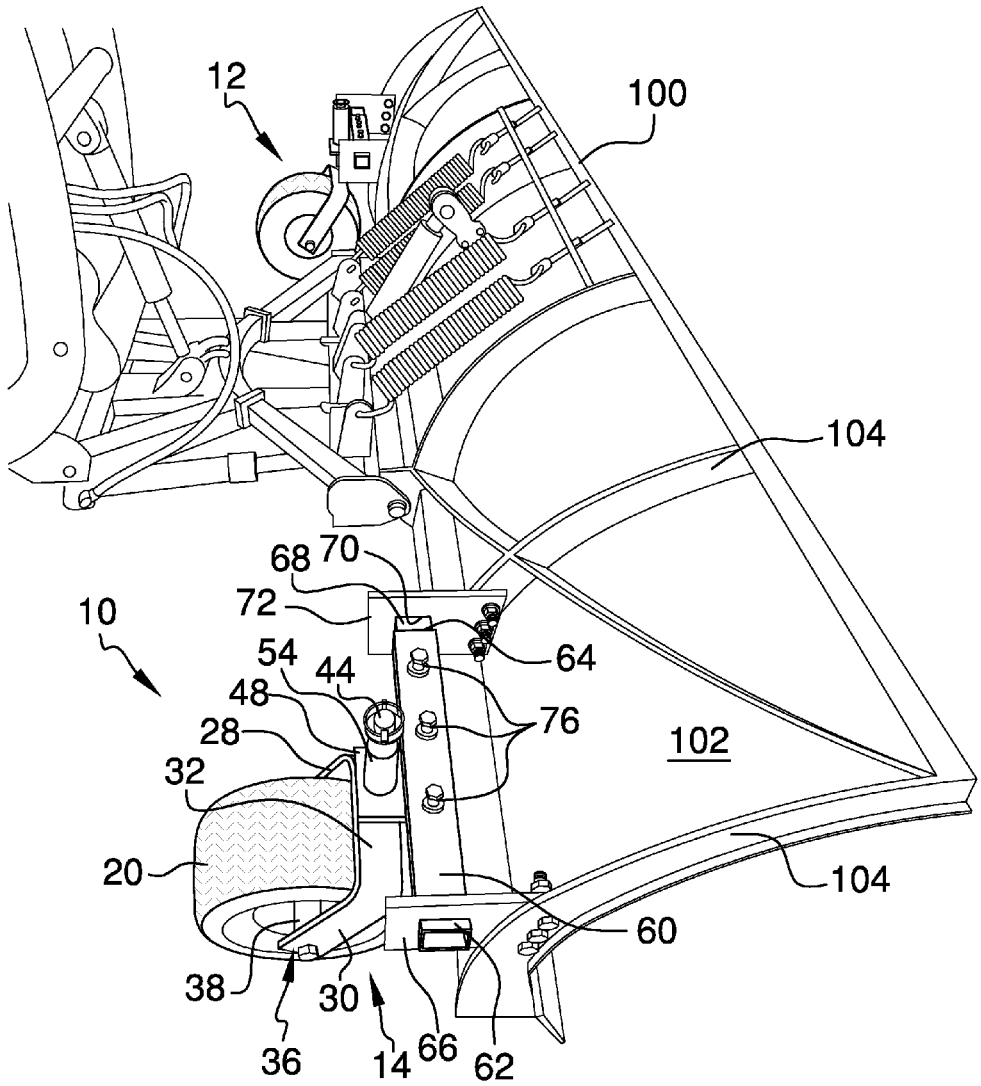
FIG. 1 is a side elevation view installed on a snowplow blade.
Figure 2:
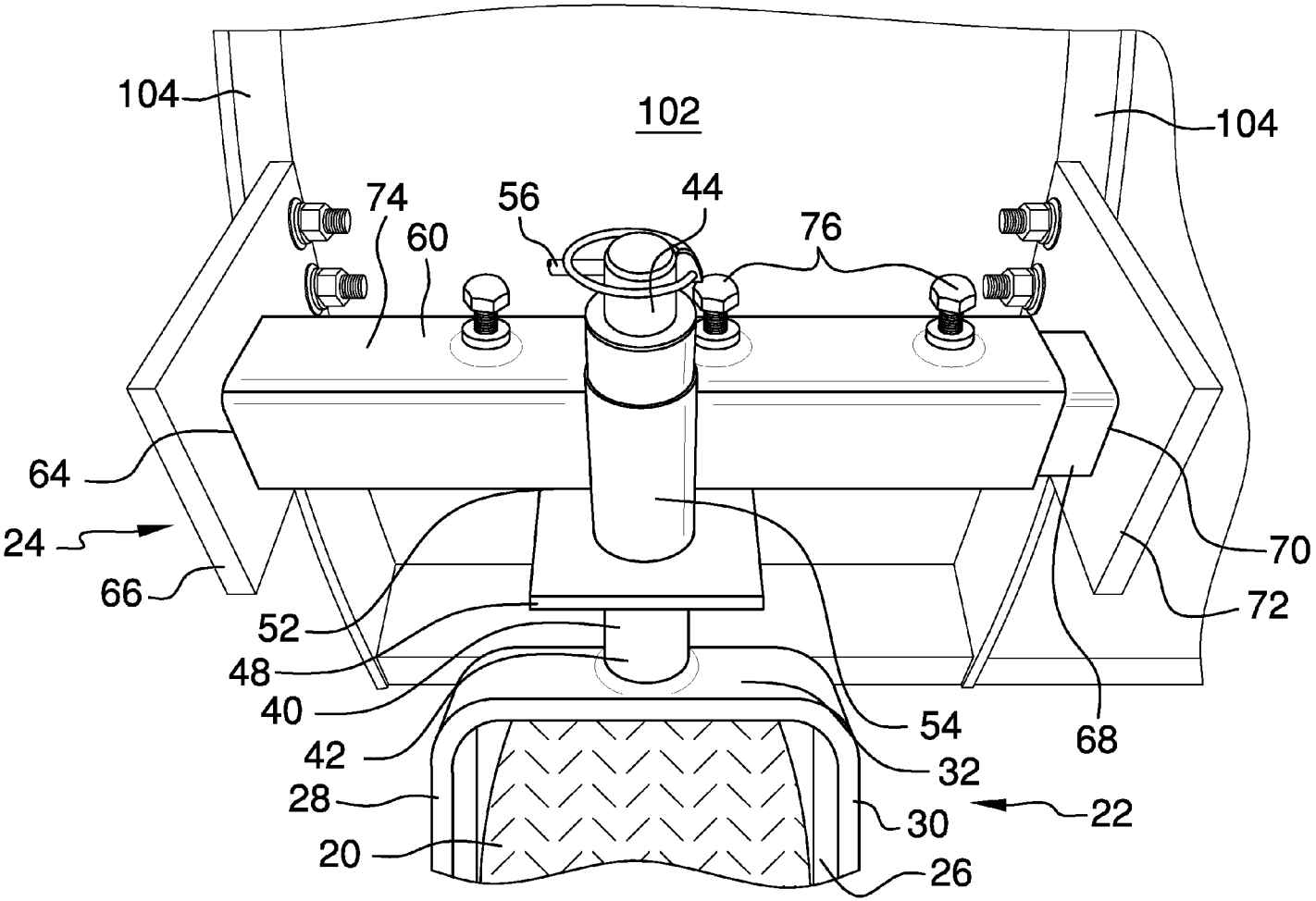
FIG. 2 is a front elevation view illustrating wheel assembly inserted into a receiver mount and installed on a snowplow blade.
Figure 3:
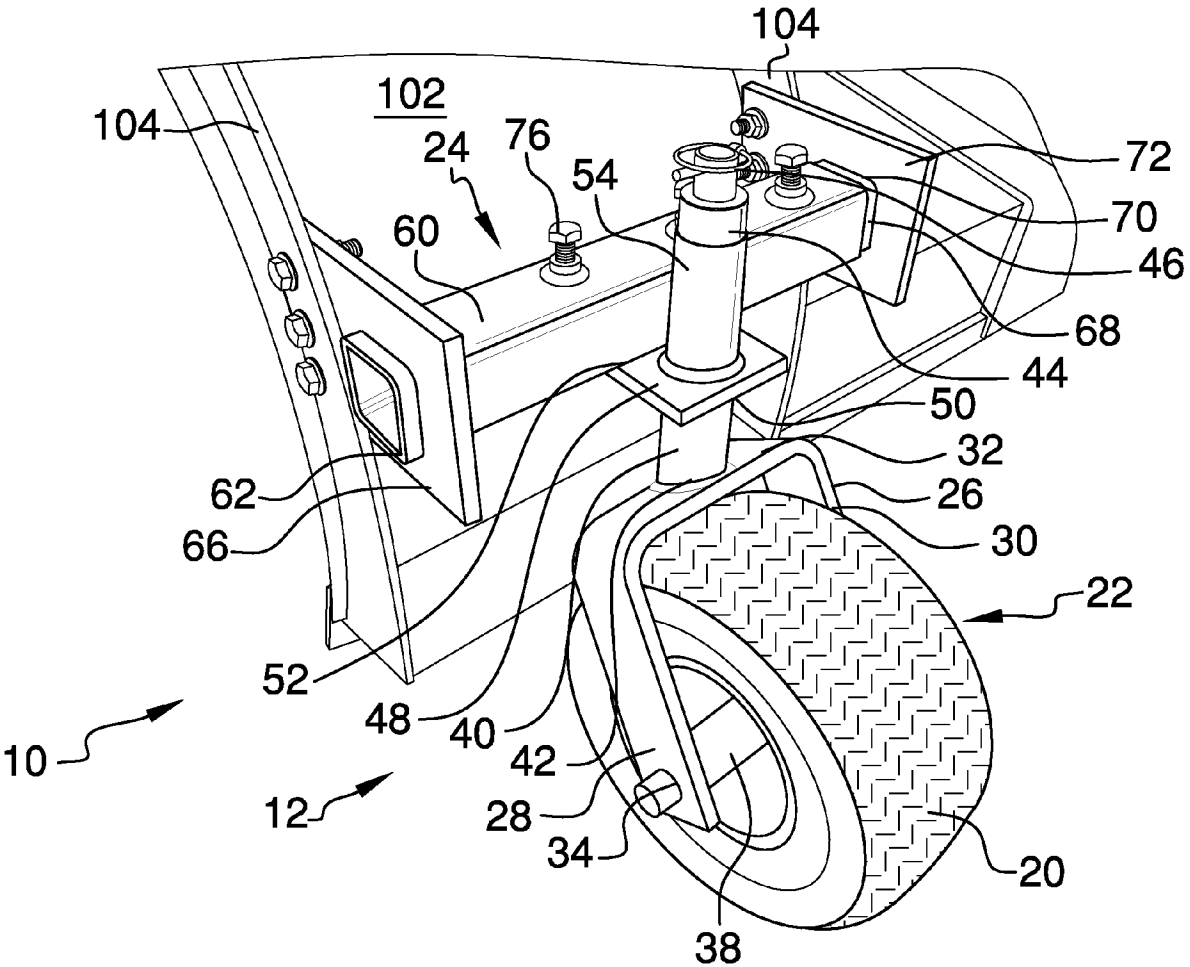
FIG. 3 is a side elevation view of a left unit installed on a snowplow blade.
Figure 4:
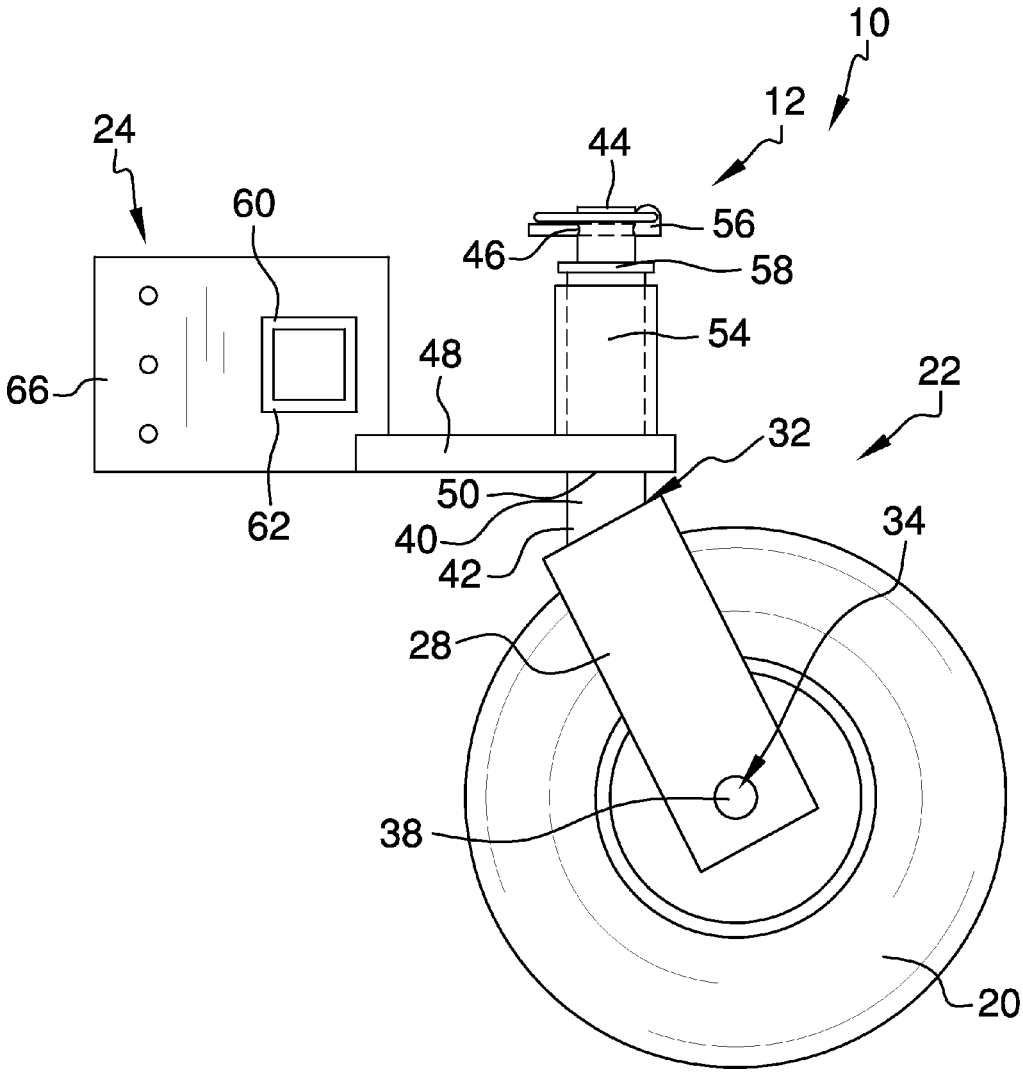
FIG. 4 is a side view of a left unit.
Figure 5:
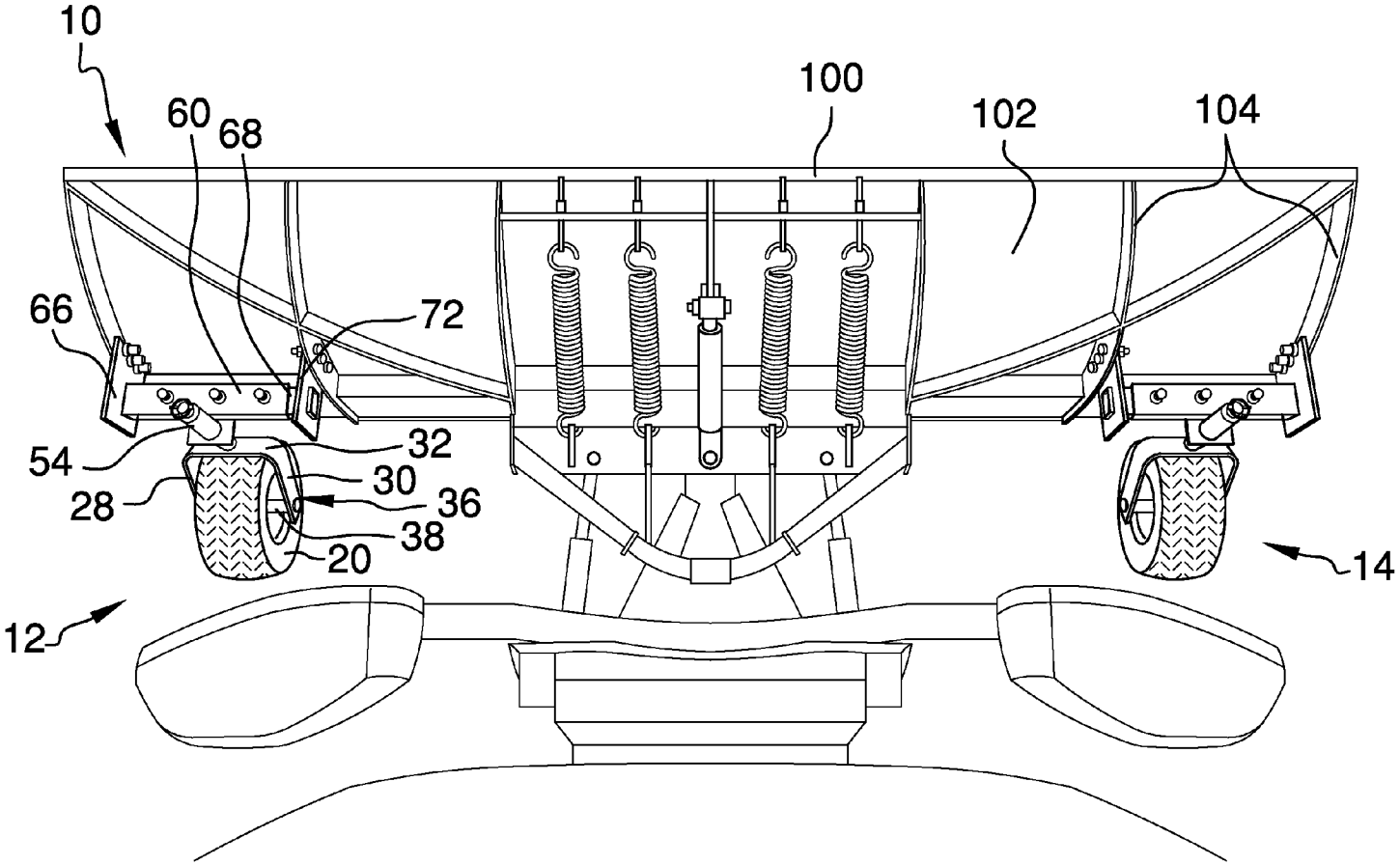
FIG. 5 is a top view showing the present snowplow wheel kit installed on a snowplow.

With reference now to the drawings, and in particular FIGS. 1 through 5 thereof, the principles and concepts of the snowplow wheel kit generally designated by the reference number 10 will be described.

Referring to FIGS. 1 through 5, a snowplow wheel kit 10 in combination with a standard snowplow 100 is illustrated, said snowplow 100 having a snowplow blade 102. The snowplow wheel kit 10 includes a left unit 12 and a right unit 14. Each of the left 12 and right 14 unit include a wheel 20, a castering assembly 22, and an adjustable receiver mount 24.

The castering assembly 22 includes a U-shaped mount 26 having a vertical left section 28, a vertical right section 30, and a horizontal section 32. A first aperture 34 is disposed on the left section 28, and a second aperture 36 is disposed on the right section 30. An axle 38 is rotatably disposed between the first aperture 34 and the second aperture 36. The axle 38 rotatably engages the wheel 20.

A cylindrical insert shaft 40 includes a bottom portion 42 and a top portion 44. The bottom portion 44 is attached to the horizontal section 32 of the U-shaped mount 26, and extends upwardly therefrom. The top portion 44 includes a horizontally disposed pin holes 46. The U-shaped mount 26 is disposed at an obtuse angle with respect to the insert shaft 40 bottom portion 42.

The adjustable receiver mount 24 is attachable to an extant snowplow 100 blade 102 between each of a plurality of ribs 104 disposed upon the blade 102. The receiver mount 24 includes a horizontally disposed parallelepiped flat plate 48. The flat plate 48 has a hole 50 centrally disposed therein. The flat plate 48 also has a forward edge 52. A cylindrical sleeve 54 is perpendicularly disposed upwardly from the flat plate 48, the sleeve 54 disposed circumferentially around the hole 50. The insert shaft 40 top portion 44 slidingly engages with the sleeve 54 and the insert shaft 40 top portion 44 protrudes upwardly from within the sleeve 54. The insert shaft 40 top portion 44 is securable within the sleeve 54 at a desired height by means of a pin 56 releasably insertable into the pin hole 46. The insert shaft 40 is rotatable within the sleeve 54 enabling the castering assembly 22 to swivel.

A plurality of washers 58 is included. Each of the plurality of washers 58 is fittable atop the sleeve 54 around the insert shaft 40 top portion 44. The pin 56 releasably secures the top portion 44 of the insert shaft 40 at a desired height from within the sleeve 54 by inhibiting the insert shaft 40 top portion 44 from sliding out from the sleeve 54. Each of the plurality of washers 58 is useable to raise the insert shaft 40 top portion 44 out of the sleeve 54 to a desired height. When the pin 56 is releasably inserted into the pin hole 46, the insert shaft 40 top portion 44 is prevented from sliding out from the sleeve 54. Each of the plurality of washers 58 is also useable around the insert shaft 40 below the sleeve 54 to inhibit upward motion of the inset shaft 40 within the sleeve 54 and hold the wheel 20 in contact with the ground.

A rectangular parallelepiped outer cross-bar 60 is affixed to the forward edge 52 of the flat plate 48, the outer cross-bar 60 having a first end 62 and a second end 64. A first attachment wing 66 is perpendicularly disposed on the first end 62. A rectangular parallelepiped inner cross-bar 68 is adjustably extensible from within the outer cross-bar 60 second end 64. An outward end 70 is disposed on the inner cross-bar 68. A second attachment wing 72 is perpendicularly disposed on the outward end 70.

The outer cross-bar 60 attaches to a snowplow blade 102 by means of the first attachment wing 66, the inner cross-bar 68 attaches to a snowplow blade 102 by means of the second attachment wing 72—the inner cross-bar 68 slidingly extensible from within the outer cross-bar 60 and secureable therefrom—and the snowplow 100 is supported by the snowplow wheel kit 10 at a desired height above a ground surface.

The outer cross-bar 60 also includes a top surface 74, said top surface 74 having a plurality of adjustment members 76 disposed therein. These adjustment members 76 releasably engage with the inner cross-bar 68 at a desired extension from within the outer cross-bar 60, whereby the first attachment wing 66 and the second attachment wing 72 are adjustably secureable at a desired span to a snowplow blade 102, and the receiver mount 24 is thereby fittable between the plurality of ribs 104 disposed on the snowplow blade 102.

What is claimed is:

1. A snowplow wheel kit in combination with a standard snowplow, said snowplow having a snowplow blade, the snowplow wheel kit comprising:

a left unit and a right unit, each of the right and left unit comprising:

a wheel;

a castering assembly comprising:

a U-shaped mount having a vertical left section, a vertical right section, and a horizontal section;

a first aperture disposed on the left section;

a second aperture disposed on the right section;

an axle rotatably disposed between the first aperture and second aperture, the axle rotatably engaging the wheel;

a cylindrical insert shaft having a bottom portion and a top portion, the insert shaft disposed upwardly from the horizontal section;

an adjustable receiver mount attachable to a snowplow blade, the receiver mount comprising:

a horizontally disposed parallelepiped flat plate, the flat plate having a hole centrally disposed therein and a forward edge;

a sleeve perpendicularly disposed upwardly from the flat plate, the sleeve disposed circumferentially around the hole;

an outer cross-bar affixed to the forward edge, the outer cross-bar having a first end and a second end;

a first attachment wing perpendicularly disposed on the first end;

an inner cross-bar adjustably extensible from within the outer cross-bar;

an outward end disposed on the inner cross-bar;

a second attachment wing perpendicularly disposed on the outward end;

wherein the insert shaft top portion slidingly engages within the sleeve, the outer cross-bar attaches to a snowplow blade by means of the first attachment wing, the inner cross-bar attaches to a snowplow blade by means of the second wing;

wherein the inner cross-bar is slidingly extensible from within the outer cross-bar and secureable therefrom;

whereby the snowplow is supported by the snowplow wheel kit at a desired height above a ground surface.

2. The snowplow wheel kit of claim 1 wherein the U-shaped mount horizontal section is disposed at an obtuse angle from the insert shaft bottom portion.

3. The snowplow wheel kit of claim 2 wherein the outer cross-bar further comprises a plurality of adjustment members disposed therein, said adjustment members releasably engaging the inner cross-bar at a desired extension from within the outer cross-bar, whereby the first attachment wing and the second attachment wing are adjustably secureable at a desired span and the receiver mount is fittable between a plurality of ribs disposed on the snowplow blade.

4. The snowplow wheel kit of claim 3 wherein the insert shaft top portion further comprises a pin hole.

5. The snowplow wheel kit of claim 4 wherein the insert shaft top portion is securable within the sleeve at a desired height.

6. The snowplow wheel kit of claim 5 wherein the insert shaft top portion protrudes upwardly from within the sleeve.

7. The snowplow wheel kit of claim 6 further comprising a pin releasably insertable into the pin hole.

8. The snowplow wheel kit of claim 6 further comprising a plurality of washers, each of the plurality of washers fittable atop and beneath the sleeve around the insert shaft respective top portion and bottom portion, wherein the pin secures the top portion of the insert shaft at a desired height from within the sleeve.

* * * * *